US006402431B1

(12) United States Patent
Nish

(10) Patent No.: US 6,402,431 B1
(45) Date of Patent: Jun. 11, 2002

(54) COMPOSITE BUOYANCY MODULE WITH FOAM CORE

(75) Inventor: Randall W. Nish, Provo, UT (US)

(73) Assignee: Edo Corporation, Fiber Science Division, Salt Lake City, UT (US)

( * ) Notice: Subject to any disclaimer, the term of this patent is extended or adjusted under 35 U.S.C. 154(b) by 0 days.

(21) Appl. No.: 09/621,207

(22) Filed: Jul. 21, 2000

(51) Int. Cl.[7] ..... E02D 5/34
(52) U.S. Cl. ..... 405/224.3
(58) Field of Search ..... 405/205, 207, 405/210, 224, 224.5, 224.3, 195.1, 224.4; 175/7, 8, 9; 166/338, 339, 344, 345, 350, 354, 355, 359

(56) References Cited

U.S. PATENT DOCUMENTS 3,470,838 A 10/1969 Daniell
RE28,966 E * 9/1976 Blockwick ..... 61/1
4,702,321 A 10/1987 Horton
4,740,109 A * 4/1988 Horton ..... 405/224
5,558,467 A 9/1996 Horton

* cited by examiner

*Primary Examiner*—Robert E. Pezzuto
(74) *Attorney, Agent, or Firm*—Thorpe North & Western

(57) ABSTRACT

A buoyancy system for a floating platform includes at least one composite buoyancy module coupled to a riser. The composite buoyancy module is sized to have a volume to produce a buoyancy force. The composite buoyancy module may include a vessel with a composite vessel wall. A layer of buoyant material fills the volume of the vessel between a stem pipe and the vessel. The buoyant material may be foam. The layer may include a plurality of discrete sections interconnected to form the layer. Protrusions and indentations may be formed in the sections to mate and interlock the sections.

30 Claims, 13 Drawing Sheets

COMPOSITE BUOYANCY MODULE WITH FOAM CORE

BACKGROUND OF THE INVENTION

1. The Field of the Invention

The present invention relates generally to a composite buoyancy module or can for supporting a object in water, like a riser of a floating oil platform or mooring lines. More particularly, the present invention relates to a buoyancy module formed of a composite outer shell or vessel, and a layer of buoyant material filling the volume of the shell or vessel.

2. The Background Art

For the purposes of describing the preferred embodiment, reference will be made to mainly one embodiment usage, that of an off shore platform riser support system. However, it is noted that there are many uses for the preferred embodiment that will become apparent to a skilled artisan after reviewing the specification, claims and drawings of the present invention. Specifically, the current invention easily can be applied to mooring lines used in the oil platform industry.

As the cost of oil increases and/or the supply of readily accessible oil reserves are depleted, less productive or more distant oil reserves are targeted, and oil producers are pushed to greater extremes to extract oil from the less productive oil reserves, or to reach the more distant oil reserves. Such distant oil reserves may be located below oceans, and oil producers have developed offshore drilling platforms in an effort to extend their reach to these oil reserves.

In addition, some oil reserves are located farther offshore, and thousands of feet below the surface of the oceans. Certain floating oil platforms, known as spars, or Deep Draft Caisson Vessels (DDCV) have been developed to reach these oil reserves. Steel tubes or pipes, known as risers, are suspended from these floating platforms, and extend the thousands of feet to reach the ocean floor, and the oil reserves beyond.

It will be appreciated that these risers, formed of thousands of feet of steel pipe, have a substantial weight which must be supported by buoyant elements at the top of the risers. Steel air cans have been developed which are coupled to the risers and disposed in the water to help buoy the risers, and eliminate the strain on the floating platform, or associated rigging. One disadvantage with the air cans is that they are formed of metal, and thus add considerable weight themselves. Thus, the metal air cans must support the weight of the risers and themselves. In addition, the air cans are often built to pressure vessel specifications, and are thus costly and time consuming to manufacture. The air cans are often pressurized with air to prevent water from filling the cans. Thus, another disadvantage with some air cans is the trouble associated with keeping the cans pressurized, such as air compressors, air lines, etc.

In addition, as risers have become longer by going deeper, their weight has increased substantially. One solution to this problem has been to simply add additional air cans to the riser so that several air cans are attached in series. It will be appreciated that the diameter of the air cans is limited to the width of the well bays within the platform structure, while the length is merely limited by the practicality of handling the air cans. For example, the length of the air cans is limited by the ability or height of the crane that must lift and position the air can. One disadvantage with more and/or larger air cans is that the additional cans or larger size adds more and more weight which also must be supported by the air cans, decreasing the air can's ability to support the risers. Another disadvantage with merely stringing a number of air cans together is that long strings of air cans may present structural problems themselves. For example, a number of air cans pushing upwards on one another, or on a stem pipe, may cause the cans or stem pipe to buckle.

Another disadvantage of steel air cans is that buoyancy is lost if the air inside the air can is lost. The loss of enough buoyancy due to loss of air may cause the riser to collapse under its own weight. Substantially, the same problems exist for mooring lines and other devices needing to be floated. Steel or synthetic foam buoyancy elements using steel truss structural members are required to lift the weight of the mooring lines used to hold the platform in position. However, the buoyant elements are underwater and located at great distances from a compressed air source. Therefore, synthetic foams not requiring human intervention are used. Unfortunately, such foam fiber structures are difficult to make because of the structure's own size makes tooling heavy and expensive. In addition, the resins used in syntactic foams undergo an exothermic reaction while curing. This heat must be released during curing or the foam will be damaged. The larger the part the more difficult it becomes to dissipate the heat.

Free standing riser systems, typically used in deep water oil and gas recovery, extends from the ocean floor to within 100 to 500 feet of the ocean surface. Below these depths, the riser is relatively free from the surface effects of wind, surface waves and currents. To maintain the free standing risers, air filled buoyancy elements get the top of the riser to provide the required tension to maintain the structure at the highest possible position. These air cans suffer from the same problems as air cans located on other oil recover platforms.

SUMMARY OF THE INVENTION

It has been recognized that it would be advantageous to optimize the systems and processes of accessing oil reserves, such as deep water oil reserves. In addition, it has been recognized that it would be advantageous to develop a system for reducing the weight of air cans, and thus the various riser systems and platforms. In addition, it has been recognized that it would be advantageous to develop a system for increasing the buoyancy of the air cans. In addition, it has been recognized that it would be advantageous to develop a system for providing buoyancy without the use of air pressure.

The invention provides a modular buoyancy system including one or more buoyancy modules. The buoyancy modules are vertically oriented, disposed at and below the surface of the water and coupled to a riser or stem pipe to support the riser. The one or more buoyancy modules are sized to have a volume to produce a buoyancy force at least as great as the riser or mooring lines to which they are attached, for example.

In accordance with one aspect of the present invention, the buoyancy module advantageously includes a composite vessel having a volume sized to produce a buoyancy force. The stem pipe is disposed concentrically through the composite vessel and receives the riser therethrough. A modular layer of buoyant material advantageously is disposed in the volume of the composite vessel, between the stem pipe and the composite vessel. Preferably, the volume is substantially filled by the layer of buoyant material, such that the layer of buoyant material substantially occupies the volume and prevents occupation of the volume by water. In addition, the layer of buoyant material may include a layer of foam material.

In accordance with another aspect of the present invention, the layer of buoyant material may include a plurality of discrete sections assembled together to form the layer. The sections may be elongated, lateral sections disposed around a circumference of the stem pipe, and oriented parallel to a longitudinal axis of the stem pipe. In addition, the sections may be annular, longitudinal sections disposed along a length of the stem pipe, and oriented perpendicular to a longitudinal axis of the stem pipe.

In addition, the sections may be disposed in rows oriented perpendicularly to a longitudinal axis of the stem pipe. The sections of each row may be offset with respect to the sections of an adjacent row. Alternatively, the sections may be disposed in columns oriented parallel to a longitudinal axis of the stem pipe. The sections of each row may be offset with respect to the sections of an adjacent column.

In accordance with another aspect of the present invention, the plurality of sections may include protrusions extending therefrom, and indentations extending therein. The protrusions and indentations of adjacent sections can be mated to maintain relative positioning between the sections.

A method for fabricating a composite buoyancy module includes the step of providing an elongated stem pipe which is configured to receive the riser therethrough. A layer of buoyant material is disposed about the stem pipe to form a mandrel. Resin impregnated fiber is wrapped around the mandrel to form a composite shell around the layer of buoyant material. Again, the layer of buoyant material may be formed by assembling a plurality of sections together around the stem pipe.

Additional features and advantages of the invention will be set forth in the detailed description which follows, taken in conjunction with the accompanying drawing, which together illustrate by way of example, the features of the invention.

DETAILED DESCRIPTION

Figure 1:
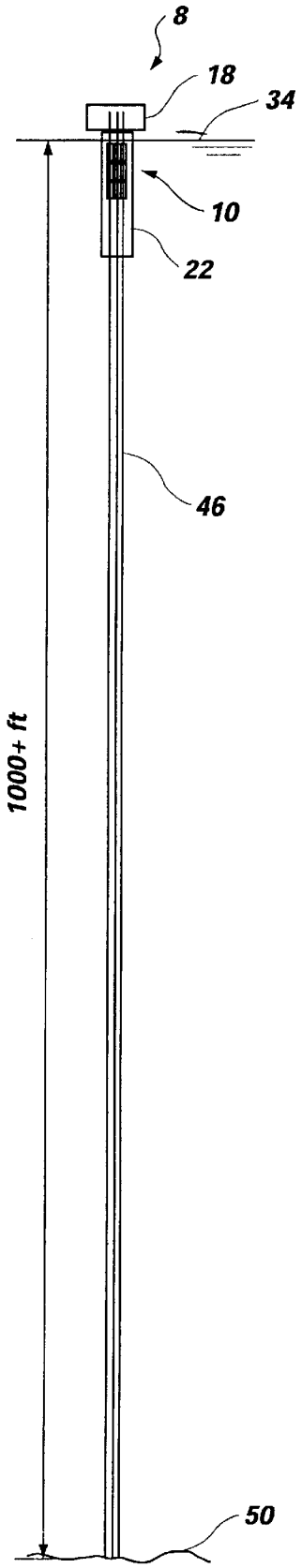
FIG. 1 is a schematic of a deep water, floating oil platform, called a spar or Deep Draft Caisson Vessel, with risers utilizing composite buoyancy modules in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
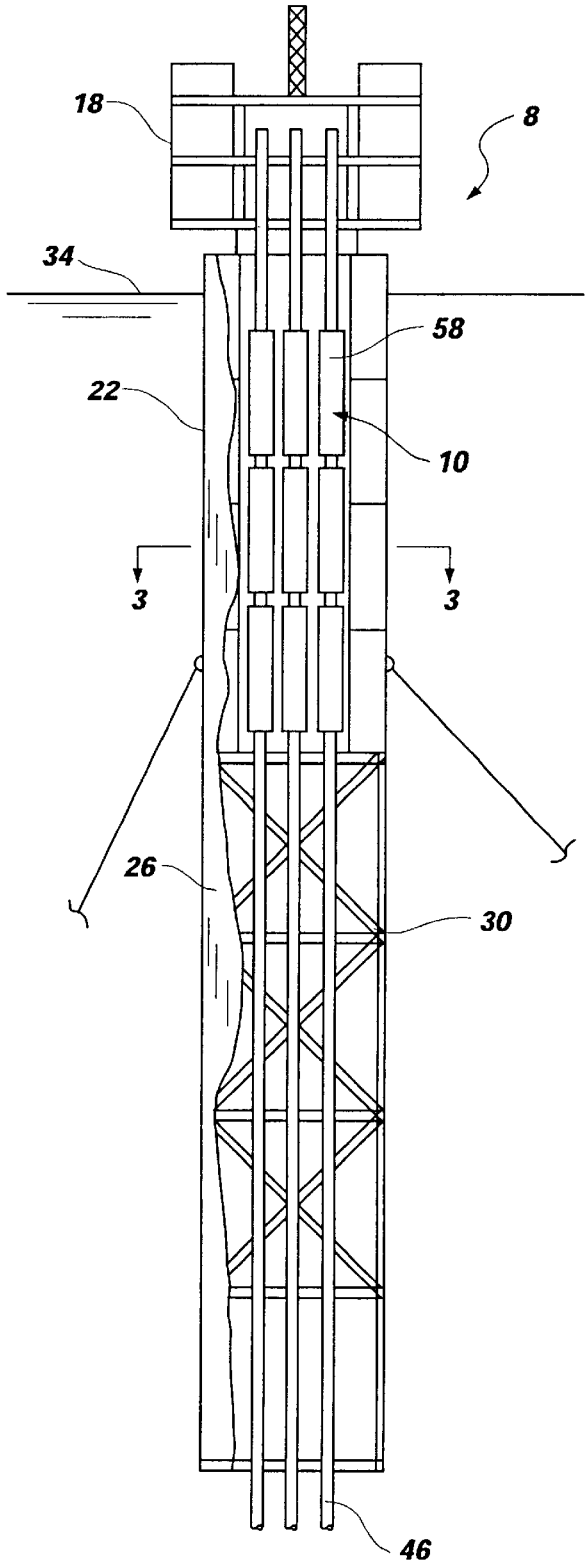
FIG. 2 is a partial, broken-away view of a preferred embodiment of the deep water, floating oil platform of FIG. 1 utilizing the composite buoyancy modules in accordance with the present invention.

As illustrated in FIGS. 1 and 2, a floating oil platform, indicated generally at 8, is shown with a buoyancy system, indicated generally at 10, in accordance with the present invention. Specifically, a deep water, floating oil platform is shown. Deep water oil drilling and production is one example of a field which may benefit from use of such a buoyancy system 10. The term "deep water, floating oil platform" is used broadly herein to refer to buoyant platforms located above and below the surface, such as are utilized in drilling and/or production of fuels, such as oil and gas, typically located off-shore in the ocean at locations corresponding to depths of over several hundred or thousand feet, including classical, truss, and concrete spar-type platforms or Deep Draft Caisson Vessels, etc. Thus, the fuel, oil or gas reserves are located below the ocean floor at depths of over several hundred or thousand feet of water. It is of course understood that the buoyancy system 10 of the present invention may be applicable to other oil platforms in more shallow waters.

A classic, spar-type, floating platform 8 or Deep Draft Caisson Vessel (DDCV) is shown in FIGS. 1 and 2, and has both above-water, or topside, structure 18, and below-water, or submerged, structure 22. The above-water structure 18 includes several decks or levels which support operations such as drilling, production, etc., and thus may include associated equipment, such as a workover or drilling rig, production equipment, personnel support, etc. The submerged structure 22 may include a hull 26, which may be a full cylinder form. The hull 26 may include bulkheads, decks or levels, fixed and variable seawater ballasts, tanks, etc. The fuel, oil or gas may be stored in tanks in the hull. The platform 8, or hull, also has mooring fairleads to which mooring lines, such as chains or wires, are coupled to secure the platform or hull to an anchor in the sea floor.

The hull 26 also may include a truss or structure 30. The hull 26 and/or truss 30 may extend several hundred feet below the surface 34 of the water, such as 650 feet deep. A centerwell or moonpool 38 (See FIG. 3) is located in the hull 26. The buoyancy system 10 is located in the hull 26, truss 30, and/or centerwell 38. The centerwell 38 is typically flooded and contains compartments 42 (FIG. 3) or sections for separating the risers and the buoyancy system 10. The hull 26 provides buoyancy for the platform 8 while the centerwell 38 protects the risers and buoyancy system 10.

It is of course understood that the classic, spar-type or (DDCV), floating platform 8 depicted in FIGS. 1 and 2 is merely exemplary of the types of floating platforms which may be utilized. For example, other spar-type platforms may be used, such as truss spars, or concrete spars. Similarly, other, shallow water platforms and free standing rises may be used as well.

The buoyancy system 10 supports deep water risers 46 which extend from the floating platform 8, near the water surface 34, to the bottom 50 of the body of water, or ocean floor. The risers 46 are typically steel pipes or tubes with a hollow interior for conveying the fuel, oil or gas from the reserve, to the floating platform 8. The term "deep water risers" is used broadly herein to refer to pipes or tubes extending over several hundred or thousand feet between the reserve and the floating platform 8, including production risers, drilling risers, and export/import risers. The risers may extend to a surface platform or a submerged platform.

The deep water risers 46 are coupled to the platform 8 by a thrust plate 54 (FIG. 4) located on the platform 8 such that the risers 46 are suspended from the thrust plate 54. In addition, the buoyancy system 10 is coupled to the thrust plate 54 such that the buoyancy system 10 supports the thrust plate 54, and thus the risers 46, as discussed in greater detail below.

Preferably, the buoyancy system 10 is utilized to access deep water reserves, or with deep water risers 46 which extend to extreme depths, such as over 1000 feet, more preferably over 3000 feet, and most preferably over 5000 feet. It will be appreciated that thousand feet lengths of steel pipe are exceptionally heavy, or have substantial weight. It also will be appreciated that steel pipe is thick or dense (i.e. approximately 0.283 lbs/in3), and thus experiences relatively little change in weight when submerged in water, or seawater (i.e. approximately 0.037 lbs/in3). Thus, for example, steel only experiences approximately a 13% decrease in weight when submerged. Therefore, thousands of feet of riser, or steel pipe, is essentially as heavy, even when submerged.

Figure 4:
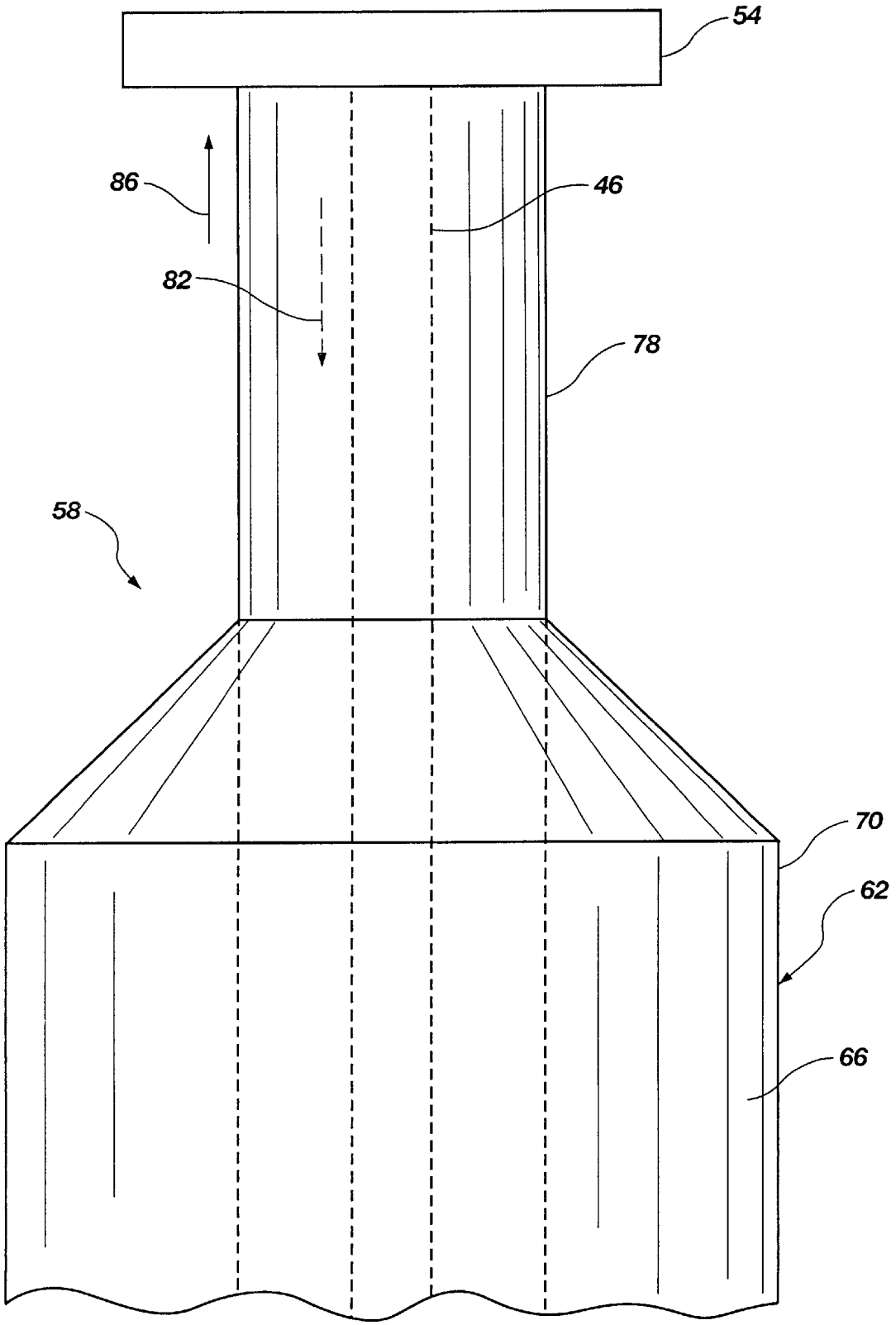
FIG. 4 is a partial side view of the composite buoyancy module in accordance with the present invention coupled to a stem pipe and riser.
Figure 5:
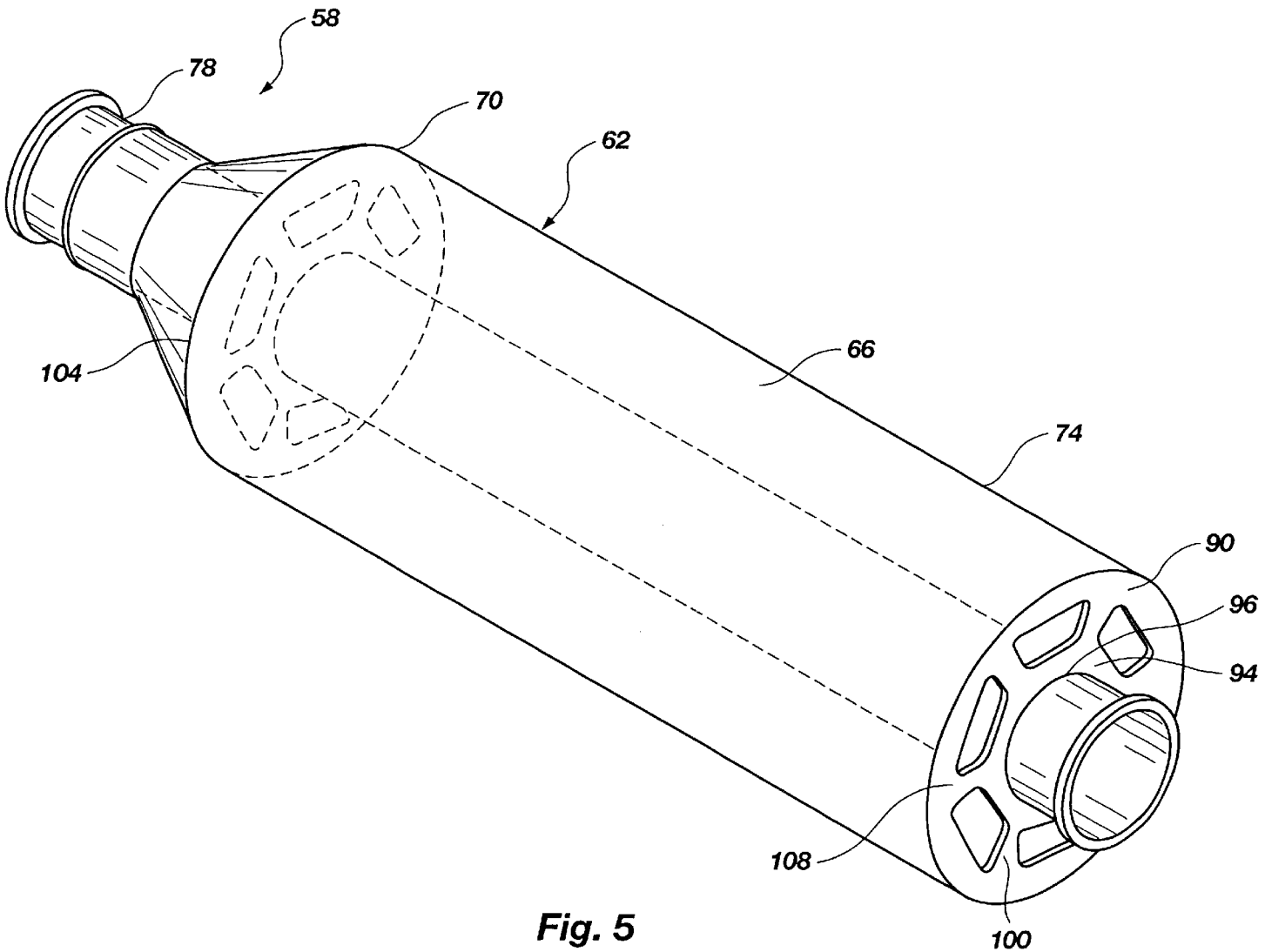
FIG. 5 is a perspective view of a composite buoyancy module in accordance with the present invention.

The buoyancy system 10 includes one or more buoyancy modules or vessels 58 which are submerged to produce a buoyancy force to buoy or support the risers 46. Referring to FIG. 5, the buoyancy module 58 includes an elongate vessel 62 with a wall 66 or shell. The elongate vessel 62 is vertically oriented, submerged, and coupled to one or more risers 46 via the thrust plate 54 (FIG. 4). The vessel 62 has an upper end 70 and a lower end 74.

Figure 6:
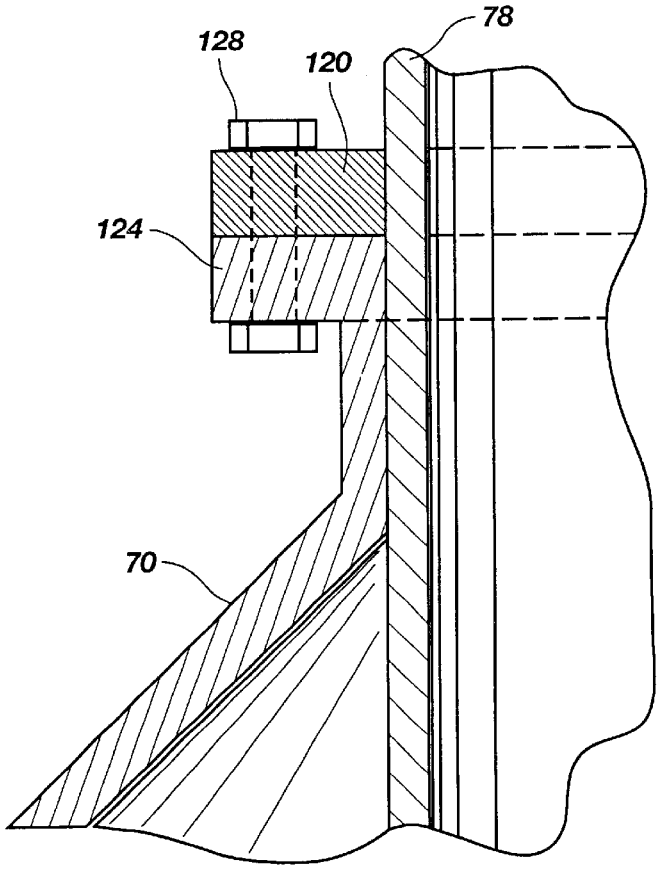
FIG. 6 is a partial cross-sectional view of a top end of a composite buoyancy module in accordance with the present invention.

In addition, the buoyancy module 58 may include a stem pipe 78 extending through the vessel 62 concentric with a longitudinal axis of the vessel 62. Preferably, the upper end 70 of the vessel 62 is coupled or attached to the stem pipe 78. As shown in FIG. 4, the stem pipe 78 may be directly coupled to the thrust plate 54 to couple the vessel 62 and buoyancy module 58 to the thrust plate 54, and thus to the riser 46. The stem pipe 78 may be sized to receive one or more risers 46 therethrough, as shown in FIG. 6.

Therefore, the risers 46 exert a downward force, indicated by arrow 82 in FIG. 4, due to their weight on the thrust plate 54, while the buoyancy module 58 or vessel 62 exerts an upward force, indicated by arrow 86 in FIG. 4, on the thrust plate 54.

Preferably, the upward force 86 exerted by the one or more buoyancy modules 58 is equal to or greater than the downward force 82 due to the weight of the risers 46, so that the risers 46 do not pull on the platform 8 or rigging.

As stated above, the thousands of feet of risers 46 exert a substantial downward force 82 on the buoyancy system 10 or buoyancy module 58. It will be appreciated that the deeper the targeted reserve, or as drilling and/or production moves from hundreds of feet to several thousands of feet, the risers 46 will become exceedingly more heavy, and more and more buoyancy force 86 will be required to support the risers 46. It has been recognized that it would be advantageous to optimize the systems and processes for accessing deep reserves, to reduce the weight of the risers and platforms, and increase the buoyance force. Referring again to FIG. 5, the vessel 62 advantageously is a composite vessel, and the vessel wall or shell 66 advantageously is formed of a fiber reinforced resin. The composite vessel 62 or vessel wall 66 preferably has a density of approximately 0.072 lbs/in3.

Therefore, the composite vessel 62 is substantially lighter than prior art air cans. In addition, the composite vessel 62 or vessel wall 66 advantageously experiences a significant decrease in weight, or greater decrease than metal or steel, when submerged. Preferably, the composite vessel 62 experiences a decrease in weight when submerged between approximately 25 to 75 percent, and most preferably between approximately 40 to 60 percent. Thus, the composite vessel 62 experiences a decrease in weight when submerged greater than three times that of steel.

The stem pipe 78 may be formed of a metal, such as steel or aluminum. The vessel 62, however, preferably is formed of a composite material. Thus, the materials of the stem pipe 78 and vessel 62 may have different properties, such as coefficients of thermal expansion. The composite material of the vessel 62 may have a coefficient of thermal expansion much lower than that of the stem pipe 78 and/or risers 46. Therefore, the stem pipe 78 is axially movably disposed within the aperture 96 of the spider structure 90, and thus axially movable with respect to the vessel 62. Thus, as the stem pipe 78 and vessel 62 expand and contract, they may do so in the axial direction with respect to one another.

For example, the composite material of the vessel 62 may have a coefficient of thermal expansion between approximately 4.0 to $8.0\times10^{-6}$ in/in/° F. for fiberglass reinforcement with epoxy, vinyl ester or polyester resin; or of $-4.4\times10^{-8}$ to $2.5\times10^{-6}$ in/in/° F. for carbon fiber reinforcement with epoxy, vinyl ester or polyester resin. In comparison, steel has a coefficient of thermal expansion between 6.0 to $7.0\times10^{-6}$ in/in/° F.; while aluminum has a coefficient of thermal expansion between 12.5 to $13.0\times10^{-6}$ in/in/° F. Thus, the composite vessel 62 advantageously has a much smaller coefficient of thermal expansion than the stem pipe 78, and experiences a smaller expansion or contraction with temperature changes. The one or more buoyancy modules 58, or vessels 62, preferably have a volume sized to provide a buoyancy force 86 at least as great as the weight of the submerged riser 46. It will also be appreciated that motion of the floating platform 8, water motion, vibration of the floating platform 8 and associated equipment, etc., may cause the risers 46 to vibrate or move. Thus, the buoyancy modules 58 or vessels 62 more preferably have a volume sized to provide a buoyancy force at least approximately 20 percent greater than the weight of the submerged risers 46 in order to pull the risers 46 straight and tight to avoid harmonics, vibrations, and/or excess motion.

The top end 70 of the vessel 62 may be attached to the stem pipe 78. Referring to FIG. 6, an annular flange 120 may be attached to the stem pipe 78. The upper end 70 of the vessel 62 may taper conically to surround the stem pipe 78, and be provided with an annular flange 124 which abuts the annular flange 120 of the stem pipe 78. The annular flange 124 may be integrally formed with the vessel 62, or a separate piece attached to the vessel 62. The vessel 62 may be attached to the stem pipe 78 by attaching the two flanges 120 and 124 such as by bolts 128, rivets, etc. Alternatively, the two may be adhered.

Figure 7:
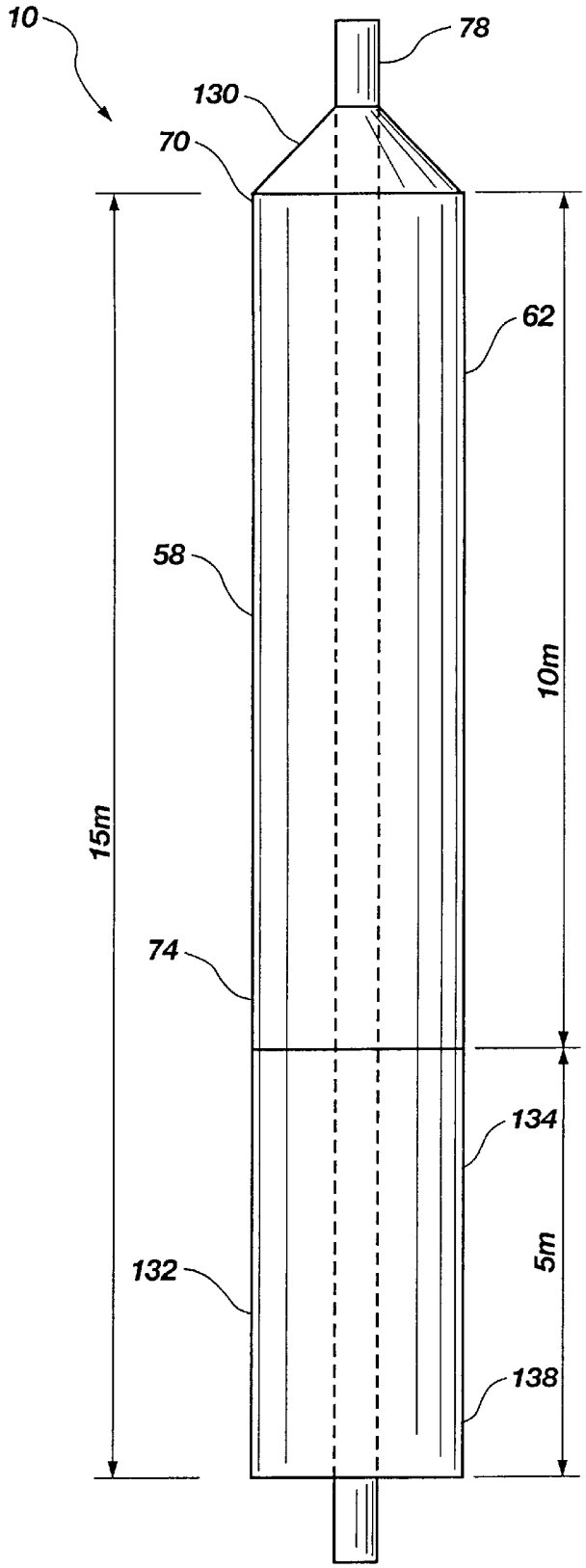
FIG. 7 is a side view of a pair of composite buoyancy modules in accordance with the present invention.

Referring to FIG. 7, the buoyancy module 58 may include an end cap 130 attached to the upper end 70 of the vessel 62. The end cap 130 may seal the upper end 70 of the buoyancy module 58 and couple the vessel 62 to the stem pipe 78, and thus the riser. The end cap 130 may include the annular, end cap flange 124 connected to the annular pipe flange 120 of the stem pipe 78, as shown in FIG. 6.

The buoyancy module 58 or vessel 62 preferably has a diameter or width of approximately 3 to 4 meters, and a length of approximately 10 to 20 meters. The diameter or width of the buoyancy modules 58 is limited by the size or width of the compartments 42 of the centerwell 38 or grid structure 112, while the length is limited to a size that is practical to handle.

Referring to FIG. 7, the buoyancy system 10 advantageously may be modular, and include more than one buoyancy modules to obtain the desired volume, or buoyancy force, while maintaining each individual module at manageable lengths. For example, a first or upper buoyancy module 58 may be provided substantially as described above, while a second or lower buoyancy module 132 may be attached to the first to obtain the desired volume. The second buoyancy module 132 has upper and lower ends 134 and 138, with the upper end 134 of the second module 132 attached to the lower end 74 of the first module 58. For example, the first module 58 may be 10 meters long, while the second module 132 is 5 meters long to obtain a combined length of 15 meters and desired buoyancy force. It will be appreciated that the buoyancy modules 58 and 132 may be provided in manageable sizes for transportation and handling, and assembled when convenient, such as on site, to achieve the desired buoyancy force based on the length of the risers 46.

Figure 8:
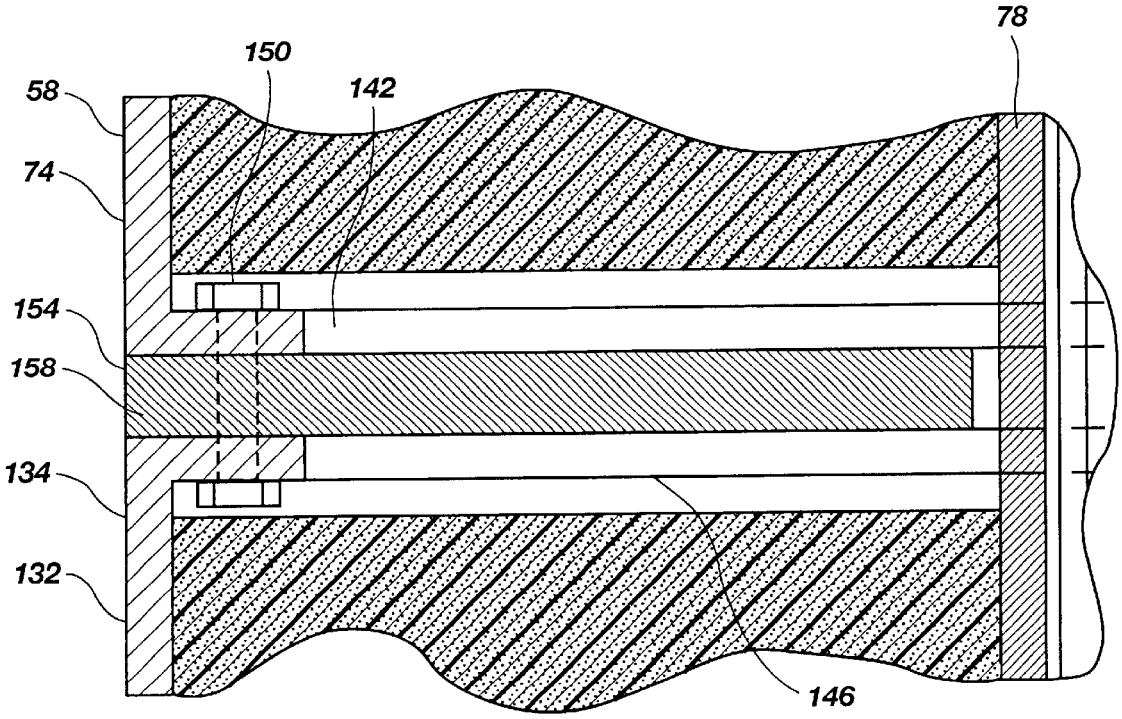
FIG. 8 is a partial cross-sectional view of the pair of composite buoyancy modules of FIG. 7.

Referring to FIG. 8, an annular flange 142 may be formed on the lower end 74 of the first or upper buoyancy module 58, and an annular flange 146 may be formed on the upper end 134 of the second or lower buoyancy module 132. The flanges 142 and 146 may be used to couple or attach the modules 58 and 132, such as with bolts 150, rivets, clamps, etc.

In addition, a spider structure or wagon wheel structure 154 may be used to couple the two modules 58 and 132 together. The spider structure 154 may include an outer annular member 158 which is located between the two modules 58 and 132 to form a seal.

Figure 9:
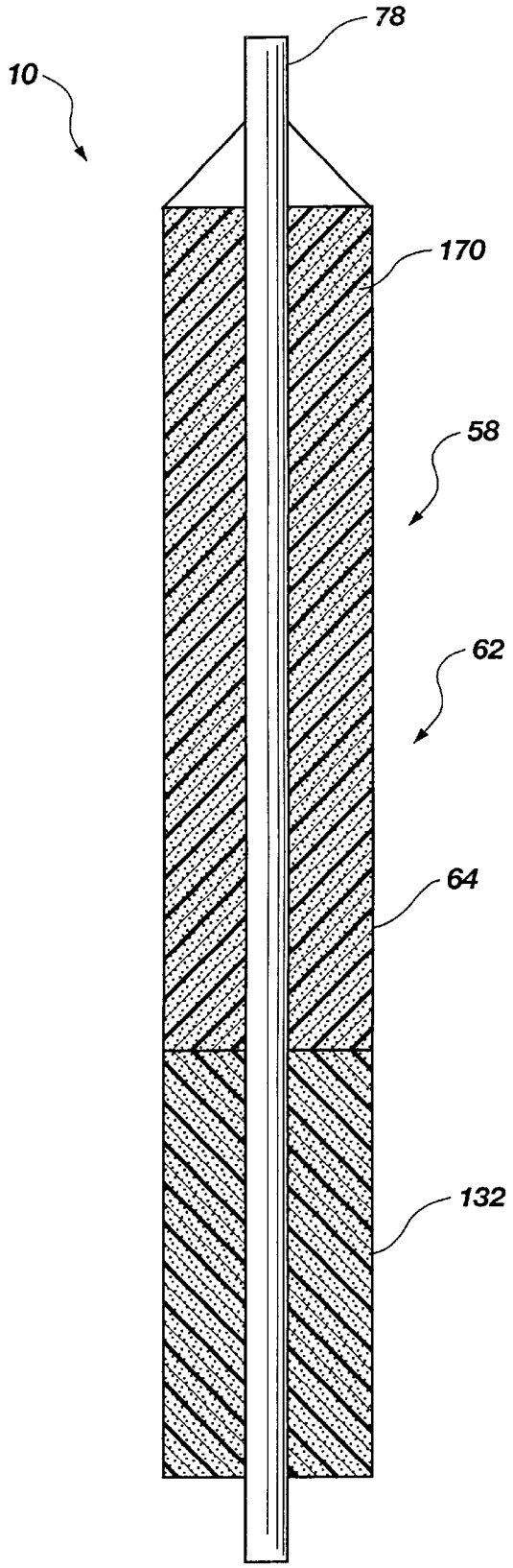
FIG. 9 is a cross-sectional side view of the pair of composite buoyancy modules of FIG. 7.

Referring to FIG. 9, a layer of buoyant material 170 advantageously fills the volume of the vessel 62 to displace any water which might otherwise fill the vessel, and to provide a buoyancy force along with the vessel 62. The layer of buoyant material 170 is disposed around the stem pipe 78, and extends between the stem pipe 78 and vessel 62 or shell 64. The buoyant material of the layer 170 preferably is a foam, or a closed cell foam, with a cell structure including air bubbles. Thus, buoyant material or foam prevents water from occupying the volume of the shell 64 or vessel 62. In addition, the layer 170 of buoyant material may be rigid, structural, or load bearing. Thus, the layer 170 may provide radial support to maintain the relative position of the stem pipe 78 in the vessel 62 or shell, and to prevent water pressure from buckling or crushing the vessel 62. In addition, the layer 170 may provide axial or longitudinal support to prevent the vessel 62 from buckling.

Figure 10:
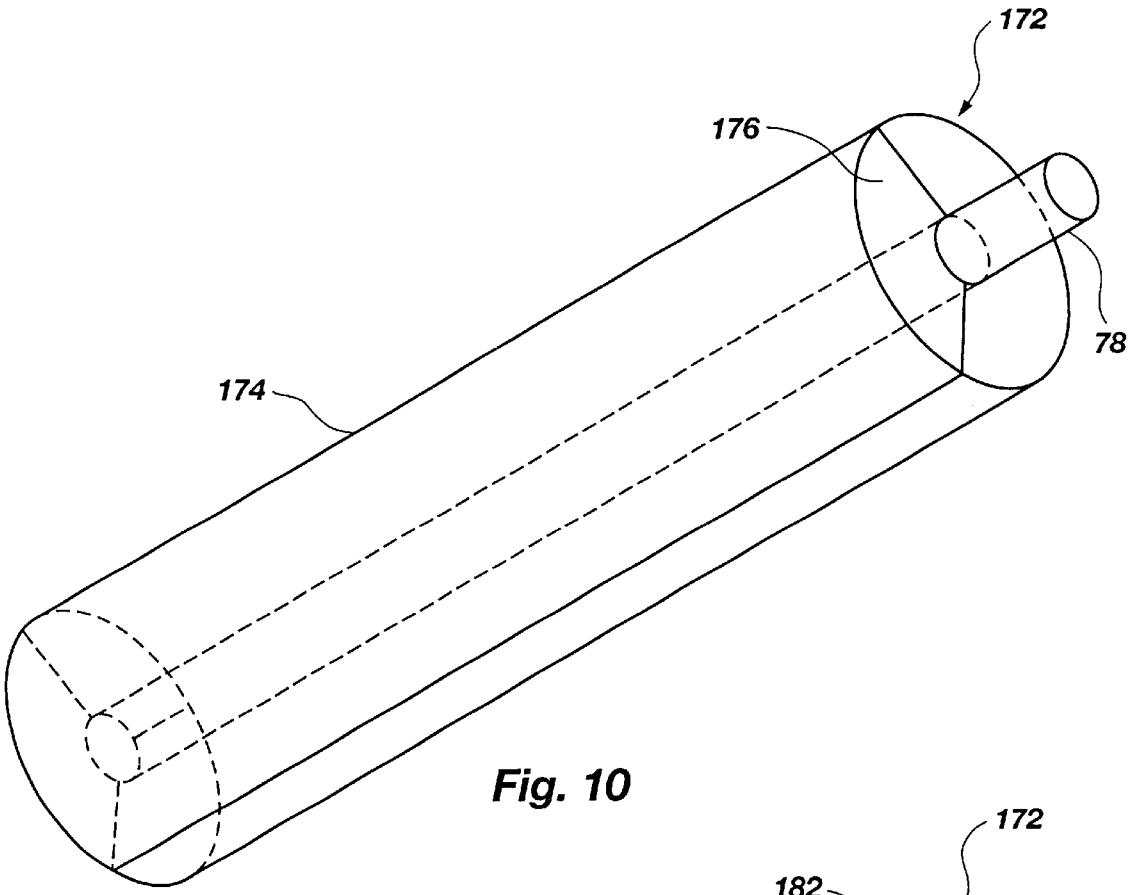
FIG. 10 is a perspective view of modular sections of buoyancy material disposed about the stem pipe in accordance with the present invention.
Figure 11:
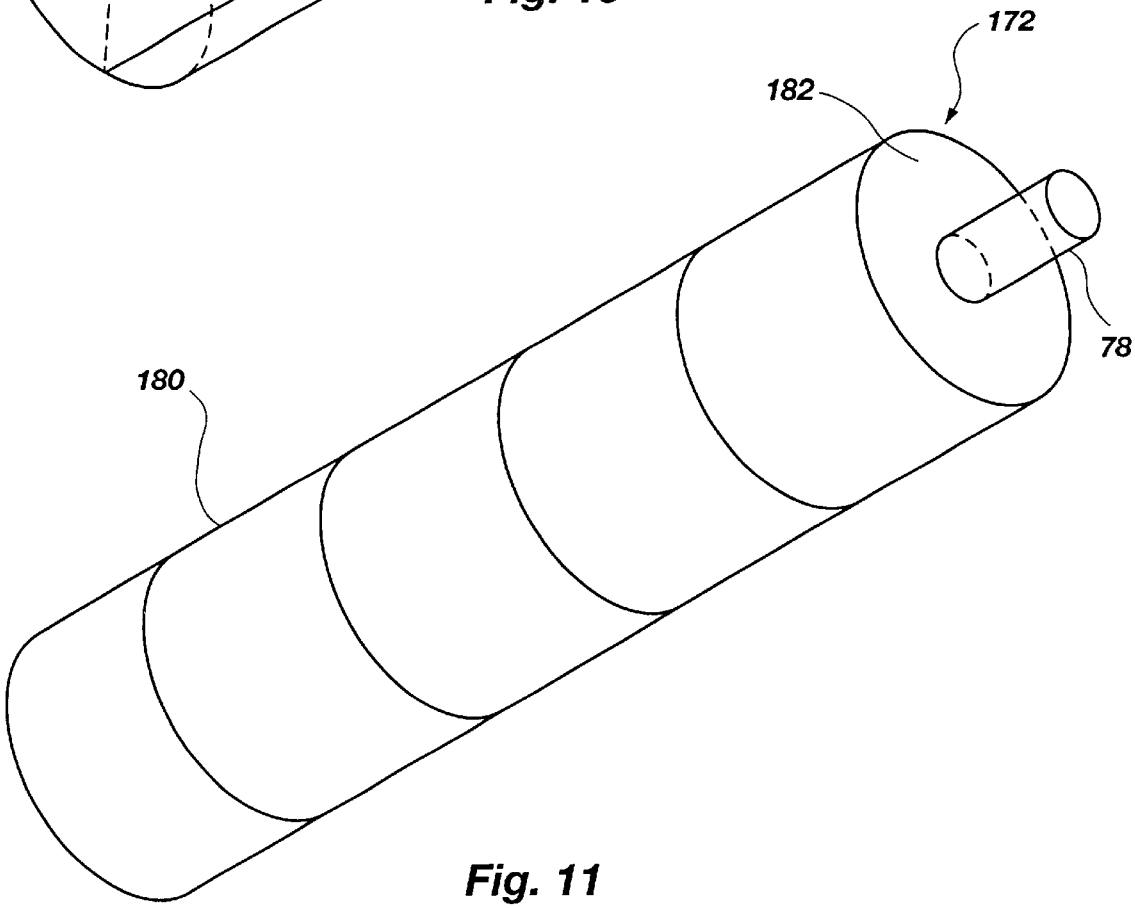
FIG. 11 is a perspective view of other modular sections of buoyancy material disposed about the stem pipe in accordance with the present invention.

Referring to FIGS. 10 and 11, the layer of buoyant material may be modular, and include a plurality of discrete sections which are assembled together to form the layer. Thus, the sections may be provided in manageable sizes for handling, processing, tooling etc. Referring to FIG. 10, a layer 174 may be formed by a plurality of elongated lateral sections 176. The sections 176 may be disposed around the circumference of the stem pipe 78, and extend lengthwise along the length of the stem pipe 78 in a parallel orientation to the longitude of the stem pipe. Thus, the layer 174 may be formed by assembling the sections 176 about the circumference of the stem pipe 78.

Figure 12:
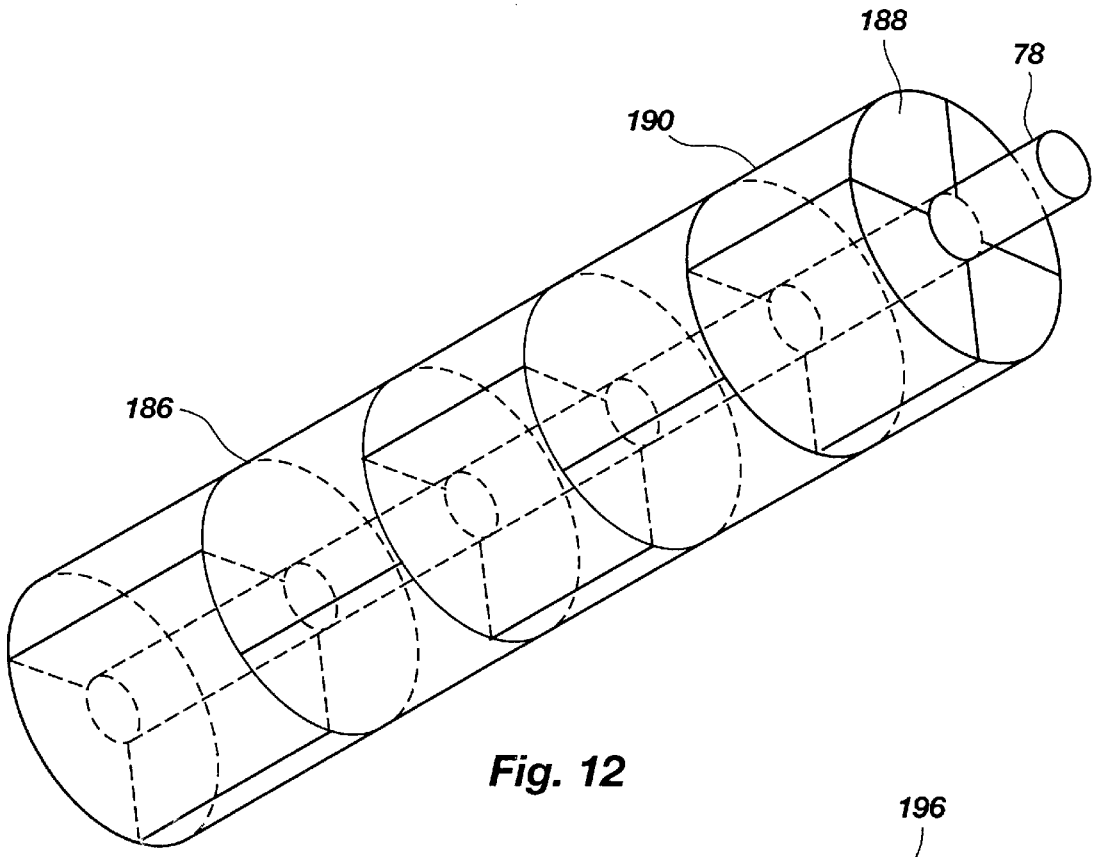
FIG. 12 is a perspective view of other modular sections of buoyancy material disposed about the stem pipe in accordance with the present invention.
Figure 13:
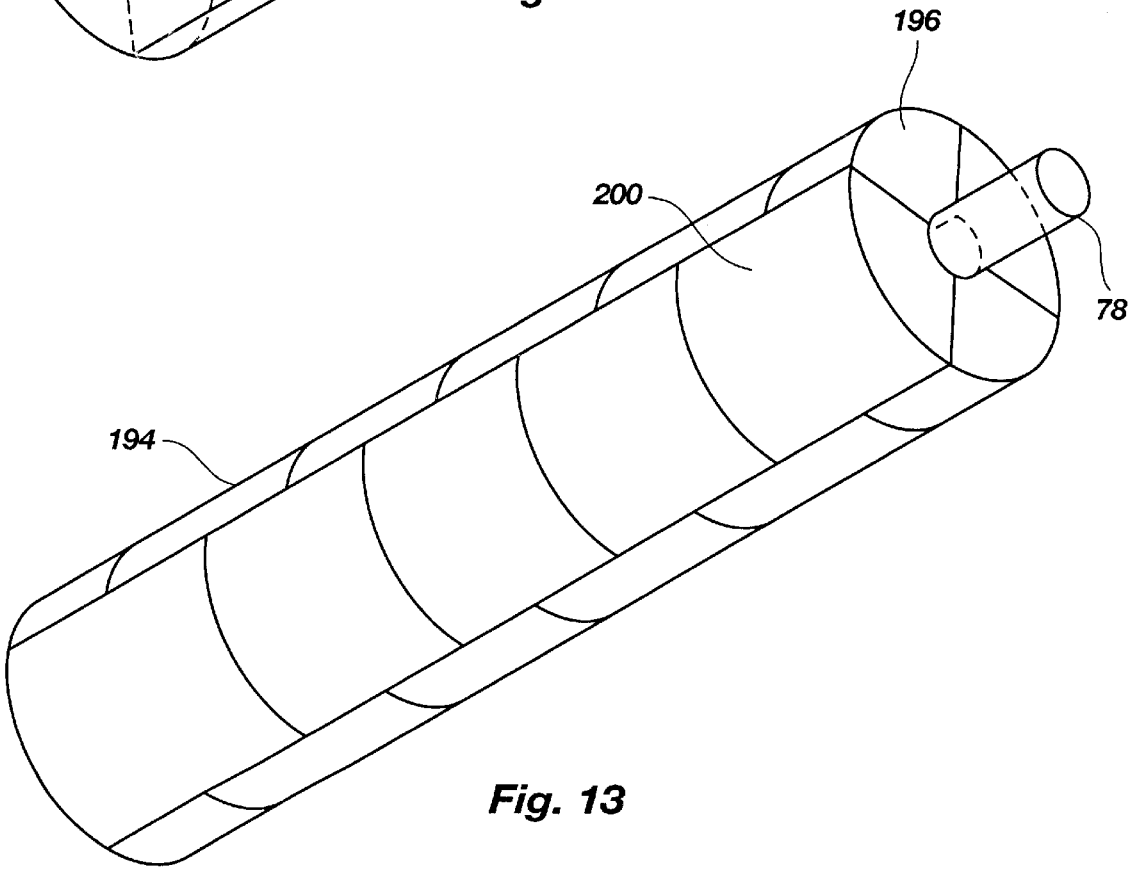
FIG. 13 is a perspective view of other modular sections of buoyancy material disposed about the stem pipe in accordance with the present invention.

Referring to FIG. 11, a layer 180 may be formed by a plurality of annular longitudinal sections 182. The sections 182 may be disposed along the length of the stem pipe 78, and be oriented perpendicular to the length or longitudinal axis of the stem pipe 78. Thus, the layer 180 may be formed by assembling the sections 182 along the axis of the stem pipe 78. Referring to FIGS. 12 and 13, the layer may be formed by a plurality of sections which are offset with respect to each other. Thus, multiple smaller sections can be assembled into the larger layer in a structural assembly. Referring to FIG. 12, a layer 186 may be formed by a plurality of sections 188 disposed about the stem pipe 78 in rows 190 which are perpendicular to the length or longitudinal axis of the stem pipe 78. Multiple rows 190 may be formed along the length of the stem pipe 78. The sections 188 of each row 190 are offset with respect to the sections of adjacent rows.

Referring to FIG. 13, a layer 194 may be formed by a plurality of sections 196 disposed along the length of the stem pipe 78 in columns 200 extending parallel with the length or longitudinal axis of the stem pipe 78. Multiple columns 200 may be disposed about the circumference of the stem pipe 78. The sections 196 of each column 200 are offset with respect to the sections of adjacent columns.

Figure 14:
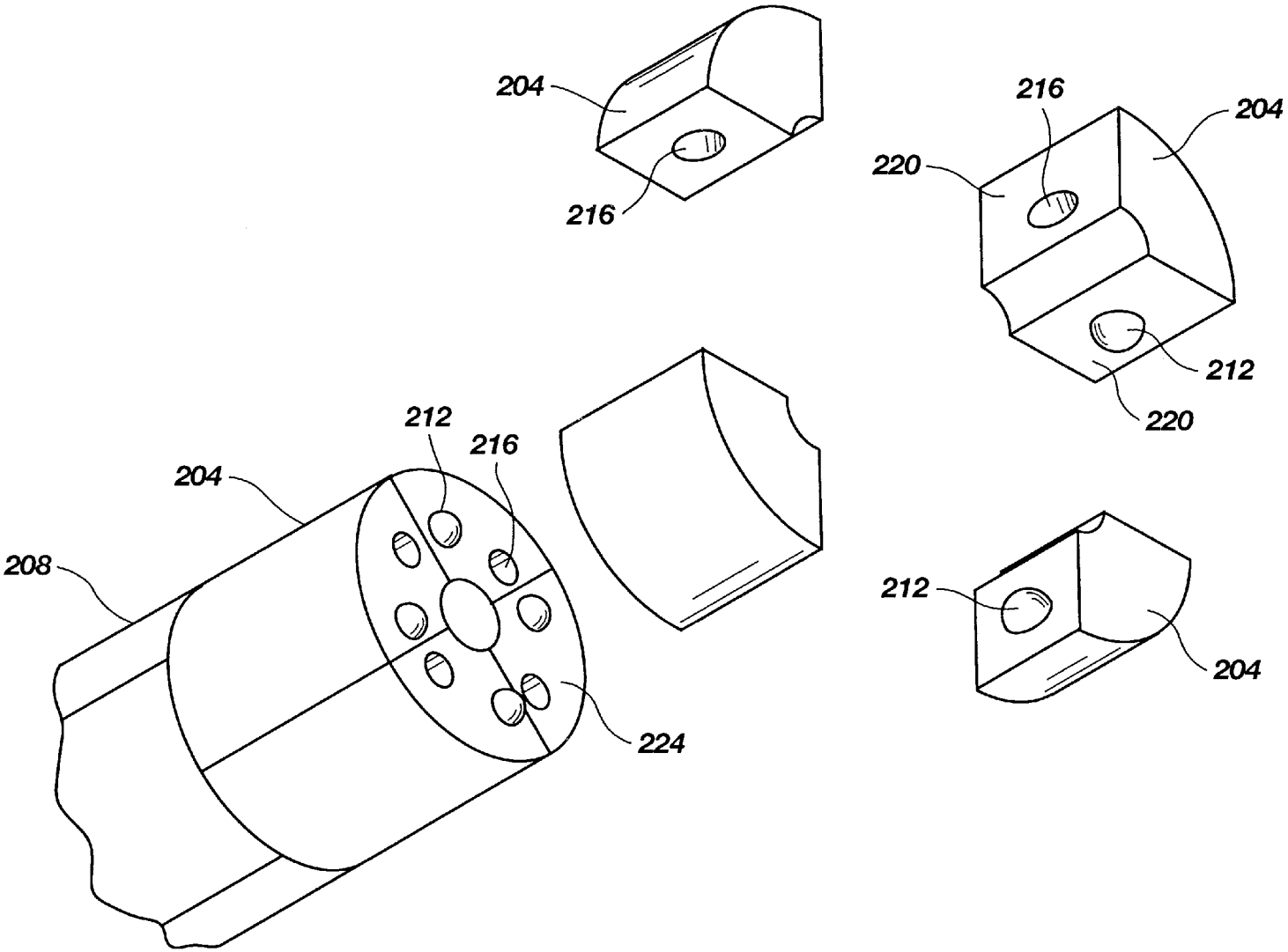
FIG. 14 is a partially exploded view of other modular sections of buoyancy material in accordance with the present invention.

Referring to FIG. 14, multiple, adjacent sections 204 of a layer 208 of buoyant material may be interlocked. The sections 204 may be provided with protrusions 212 and indentations 216. The protrusions 212 mate with the indentations 216 of adjacent sections 204 to maintain the relative position of the sections 204. The protrusions and indentations 212 and 216 may be formed on lateral sides 220 of the sections 204 to interlock with laterally or circumferentially adjacent sections. In addition, the protrusions and indentations 212 and 216 may be formed on longitudinal ends 224 of the sections 204 to interlock with longitudinally adjacent sections.

Figure 15:
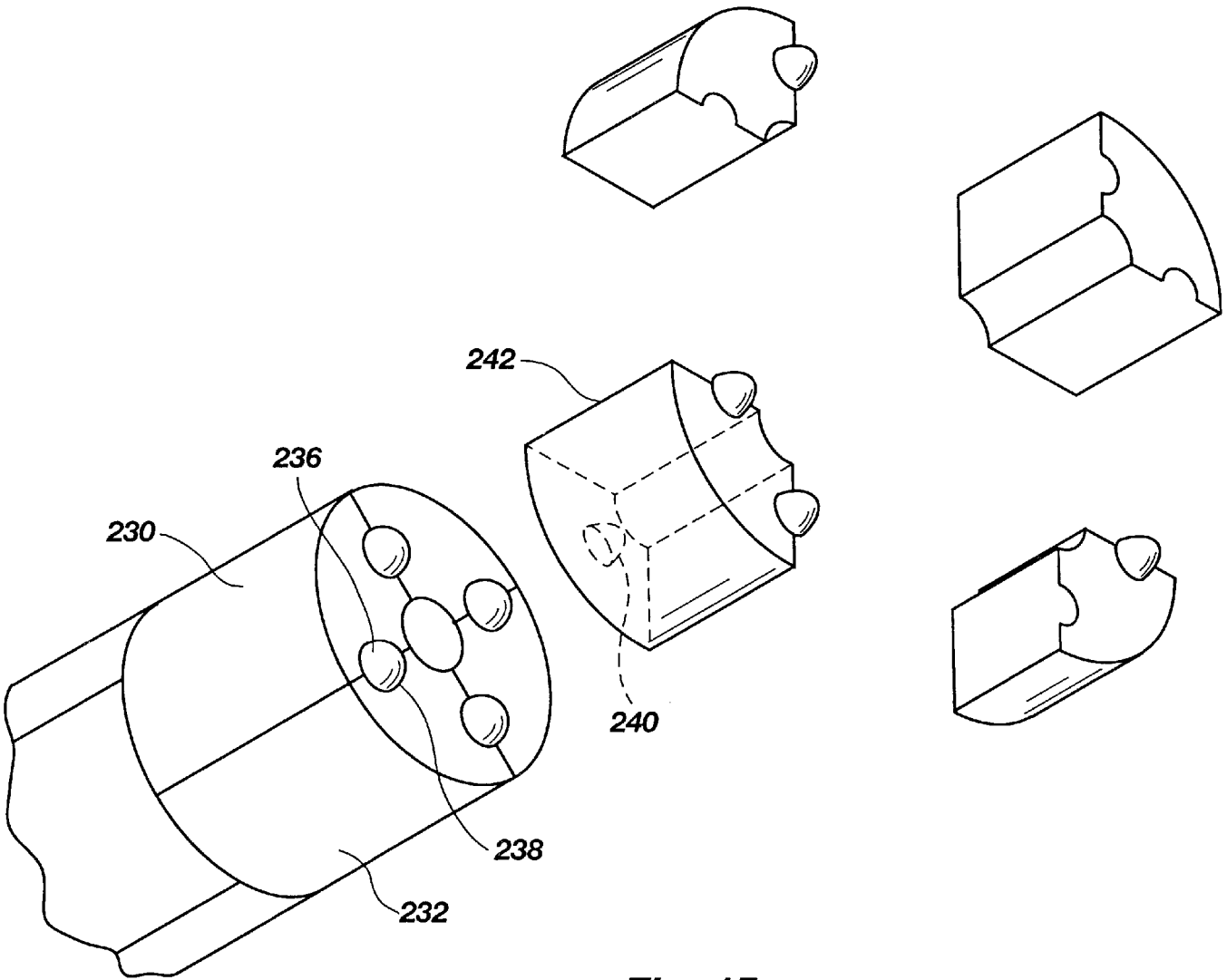
FIG. 15 is a partially exploded view of other modular sections of buoyancy material in accordance with the present invention.

Referring to FIG. 15, two adjacent sections 230 and 232 each may have a protrusion 236 and 238 which combine to mate with a single indentation 240 in an adjacent section 242. Thus, a single indentation of one section may be utilized in securing two adjacent sections.

Figure 16:
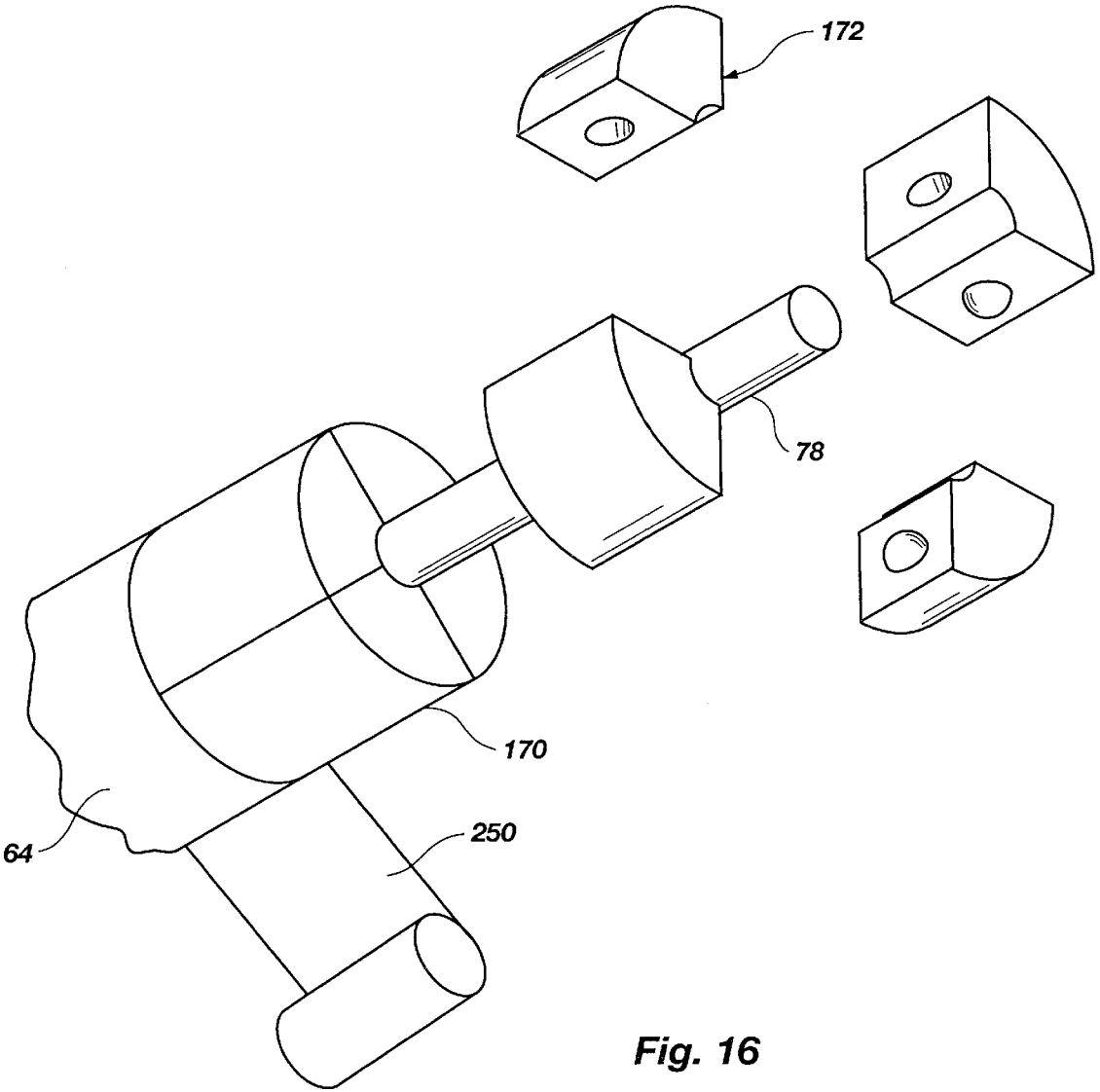
FIG. 16 is a schematic view of a method for fabricating a composite buoyancy module in accordance with the present invention.
Figure 17:
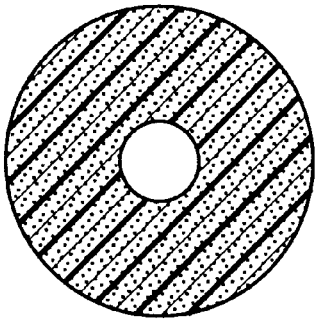
FIG. 17 is a cross-sectional end view of a composite buoyancy module in accordance with the present invention.

Referring to FIG. 16, a method for fabricating a composite buoyancy module 58 is shown. The layer 170 of buoyant material is disposed about the stem pipe 78. As stated above, the layer 170 may be formed in various different ways, and by various different sections. The layer 170 may be a single, elongated, annular layer. Alternatively, the layer 170 may be provided in sections 172, which may be elongated, longitudinal sections, lateral annular sections, and/or sections disposed in rows and/or columns. The sections 172 may be assembled about the stem pipe 78 and interlocked, such as by mating protrusions and indentations. Forming the layer 170 of buoyant material around the stem pipe 78 creates a mandrel. The layer 170 of buoyant material then may be wrapped with a resin impregnated fiber 250 to form a composite shell 64. The fiber may be impregnated before, or during, wrapping. Alternatively, the fiber may be impregnated after wrapping. The fiber may be provided in rolls of sheets which may be wrapped around the layer 170. The fiber may be wrapped in various different orientations. The fiber and resin may then be cured. The sections 172 may be formed by a molding process, where each section is molded prior to assembly.

Referring again to FIG. 3, the floating platform 8 of hull 26 may include a centerwell 38 with a grid structure 112 with one or more square compartments 42, as described above. The risers 46 and buoyancy modules 58 are disposed in the compartments 42 and separated from one another by the grid structure 112. The compartments 42 may have a square cross-section with a cross sectional area. The buoyancy module 58 and/or vessel 62 advantageously may have a non-circular cross-section with a cross sectional area greater than approximately 79 percent of the cross sectional area of the compartment 42. Thus, the cross-sectional area, and thus the size, of the buoyancy module 58 and vessel 62 are designed to maximize the volume and buoyancy force 86 of the buoyancy module 58.

Figure 18:
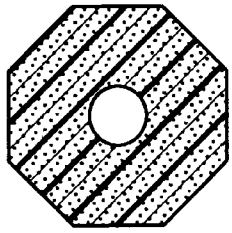
FIG. 18 is a cross-sectional end view of another composite buoyancy module in accordance with the present invention.
Figure 19:
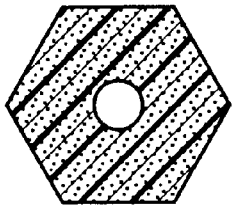
FIG. 19 is a cross-sectional end view of another composite buoyancy module in accordance with the present invention.

The buoyancy module 58 and vessel 62 may have an octagonal cross-sectional shape, as shown in FIG. 18. Alternatively, the buoyancy module 58 and vessel 62 have a hexagonal cross-sectional shape, and a cross-sectional area greater than approximately 86 percent of the cross-sectional area of the compartment 42, as shown in FIG. 19. It is of course understood that the buoyancy module 58 and vessel 62 may be any non-circular or polygonal shape to increase the percentage of cross sectional area of the compartment 42 occupied by the buoyancy module 58 and vessel 62, hence, increasing buoyancy.

Figure 3:
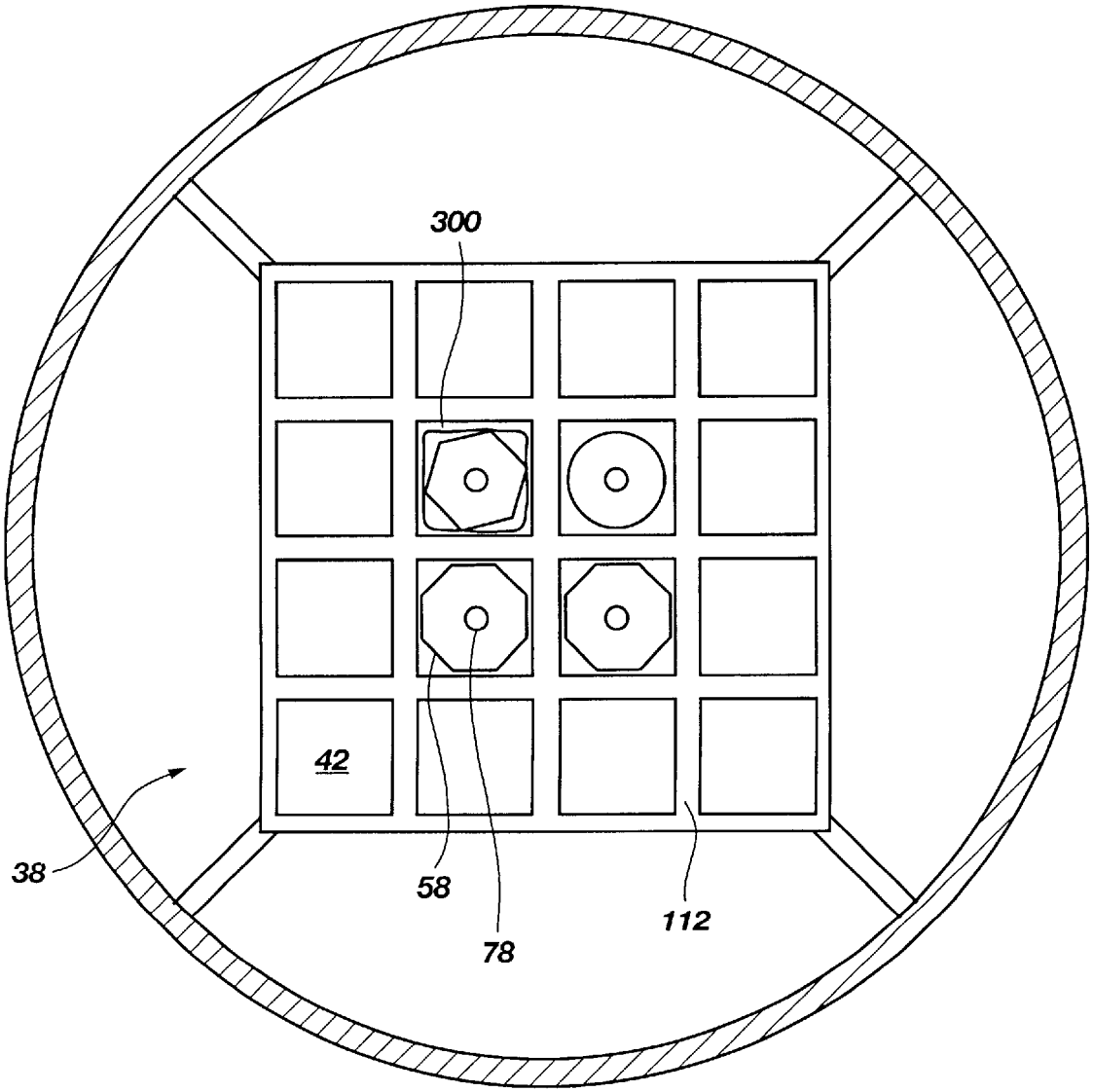
FIG. 3 is a cross-sectional view of the deep water, floating oil platform of FIG. 2 taken along line 3—3 utilizing the composite buoyancy modules in accordance with the present invention.

Referring to FIG. 3, a bumper 300 may be disposed between the grid structure 112 and buoyancy module 58 to protect the buoyancy module 58 from damage as it moves within the compartment 42. The bumper 300 may be formed of a flexible and/or resilient material to cushion impact or contact between the buoyancy module 58 and grid structure 112 as the buoyancy module 58 is installed. It will be noted that the vessel 62 of the buoyancy module 58 described above may be attached directly to the riser 46, rather than the stem pipe 78.

A skilled artisan in the design of off shore oil platforms and composite materials would realize that there are many variations that would become known after becoming familiar with the present disclosed preferred embodiments. For example, the composite module 58 may also be used on mooring lines, free standing risers, or any other oil platform components, cables, submarine nets, electronic submersible electronic devices, or can be used in the salvaging of articles, like ship wrecks.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A composite buoyancy module configured to be coupled to a tensioned member of an oil platform, comprising:

a) the tensioned member extending between the oil platform and an ocean floor;

b) a layer of buoyant material, disposed around the tensioned member, including foam material; and c) a shell of composite material, disposed around the layer of buoyant material.

2. The module of claim 1, wherein the tensioned member is a riser.

3. The composite buoyancy module of claim 1, wherein the shell and layer define a volume sized to produce a buoyancy force, the buoyancy force of multiple modules being at least as great as the weight of the tensioned member.

4. The composite buoyancy module of claim 1, further comprising a stem pipe disposed through the shell and configured to receive the tensioned member therethrough; and wherein the shell and stem pipe define a volume therebetween which is substantially filled by the layer of buoyant material, such that the layer of buoyant material substantially occupies the volume and prevents occupation of the volume by water.

5. The composite buoyancy module of claim 1, wherein the layer includes a layer of foam material.

6. The composite buoyancy module of claim 1, further comprising:

a stem pipe disposed through the shell and configured to receive the tensioned member therethrough; and wherein the layer of buoyant material includes:

a plurality of discrete sections assembled together to form the layer.

7. The composite buoyancy module of claim 6, wherein the plurality of sections are elongated, lateral sections, disposed around a circumference of the stem pipe, and oriented parallel to a longitudinal axis of the stem pipe.

8. The composite buoyancy module of claim 6, wherein the plurality of sections are annular, longitudinal sections, disposed along a length of the stem pipe, and oriented perpendicular to a longitudinal axis of the stem pipe.

9. The composite buoyancy module of claim 6, wherein the plurality of sections are disposed in rows oriented perpendicularly to a longitudinal axis of the stem pipe; and wherein the sections of each row are offset with respect to the sections of an adjacent row.

10. The composite buoyancy module of claim 6, wherein the sections are disposed in columns oriented parallel to a longitudinal axis of the stem pipe; and wherein the sections of each row are offset with respect to the sections of an adjacent column.

11. The composite buoyancy module of claim 6, wherein each of the plurality of sections further includes:

a) a protrusion extending therefrom;

b) an indentation extending therein; and c) the protrusions and indentations of adjacent sections mating to maintain relative positioning between the sections.

12. The composite buoyancy module of claim 1, wherein the layer of buoyant material and the shell have a polygonal cross sectional shape.

13. The composite buoyancy module of claim 4, further comprising: an end cap, coupled to and between the stem pipe and shell at one end thereof.

14. The composite buoyancy module configured to be coupled to a riser, comprising:

a) a composite vessel having a volume sized to produce a buoyancy force;

b) a stem pipe, disposed concentrically through the composite vessel and configured to receive the riser therethrough; and c) a modular layer of buoyant foam material, disposed in the volume of the composite vessel between the stem pipe and the composite vessel, having a plurality of discrete sections assembled together to form the layer, each section being formed of the buoyant foam material.

15. The composite buoyancy module of claim 14, wherein the plurality of sections are elongated, lateral sections, disposed around a circumference of the stem pipe, and oriented parallel to a longitudinal axis of the stem pipe.

16. The composite buoyancy module of claim 14, wherein the plurality of sections are annular, longitudinal sections, disposed along a length of the stem pipe, and oriented perpendicular to a longitudinal axis of the stem pipe.

17. The composite buoyancy module of claim 14, wherein the plurality of sections are disposed in rows oriented perpendicularly to a longitudinal axis of the stem pipe; and wherein the sections of each row are offset with respect to the sections of an adjacent row.

18. The composite buoyancy module of claim 14, wherein the sections are disposed in columns oriented parallel to a longitudinal axis of the stem pipe; and wherein the sections of each row are offset with respect to the sections of an adjacent column.

19. The composite buoyancy module of claim 14, wherein each of the plurality of sections further includes:

a) a protrusion extending therefrom; and b) an indentation extending therein; and c) the protrusions and indentations of adjacent sections mating to maintain relative positioning between the sections.

20. The composite buoyancy module of claim 14, wherein the layer of buoyant foam material substantially fills the volume of the composite shell.

21. The composite buoyancy module of claim 14, wherein the composite vessel has a polygonal cross-sectional shape.

22. The composite buoyancy module of claim 14, further comprising: an end cap, coupled to and between the stem pipe and shell at one end thereof.

23. A method for fabricating a composite buoyancy module configured to be coupled to a riser, comprising the steps of:

a) providing an elongated stem pipe which is configured to receive the riser therethrough;

b) disposing a layer of buoyant foam material about the stem pipe to form a mandrel; and c) wrapping resin impregnated fiber around the mandrel to form a composite shell around the layer of buoyant foam material.

24. The method of claim 23, wherein the step of disposing a layer of buoyant foam material further includes the steps of:

a) providing a plurality of sections of buoyant foam material; and b) assembling the plurality of sections together to form the layer of buoyant foam material around the stem pipe.

25. The method of claim 23, wherein the step of disposing a layer of buoyant foam material further includes the steps of:

a) providing a plurality of sections of buoyant foam material, each section having a protrusion and an indentation; and b) assembling the plurality of sections together to form the layer of buoyant foam material by mating the protrusions and indentations of adjacent sections.

26. The method of claim 23, wherein the step of disposing a layer of buoyant foam material further includes the steps of:

a) providing a plurality of elongated, lateral sections of buoyant foam material; and b) assembling the plurality of lateral sections to form the layer by disposing the lateral sections around a circumference of the stem pipe, and orienting the lateral sections parallel to a longitudinal axis of the stem pipe.

27. The method of claim 23, wherein the step of disposing a layer of buoyant foam material further includes the steps of:

a) providing a plurality of annular, longitudinal sections of buoyant foam material; and b) assembling the plurality of annular longitudinal sections to form the layer by disposing the annular longitudinal sections along a longitudinal axis of the stem pipe, and orienting the annular longitudinal sections perpendicular to the longitudinal axis of the stem pipe.

28. The method of claim 23, wherein the step of disposing a layer of buoyant foam material further includes the steps of:

a) providing a plurality of sections of buoyant foam material; and b) assembling the plurality of sections together to form the layer by disposing the sections in rows oriented perpendicularly to a longitudinal axis of the core, and offsetting the sections of each row with respect to the sections of an adjacent row.

29. The method of claim 23, wherein the step of disposing a layer of buoyant foam material further includes disposing a layer of buoyant foam material with a polygonal cross-section to form a mandrel with a polygonal cross-section.

30. The method of claim 23, wherein the step of disposing a layer of buoyant foam material further includes molding a plurality of sections of buoyant foam material.

* * * * *